US010885894B2

(12) United States Patent
Nam et al.

(10) Patent No.: US 10,885,894 B2
(45) Date of Patent: Jan. 5, 2021

(54) SINGING EXPRESSION TRANSFER SYSTEM

(71) Applicant: Korea Advanced Institute of Science and Technology, Daejeon (KR)

(72) Inventors: Juhan Nam, Daejeon (KR); Sangeon Yong, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 134 days.

(21) Appl. No.: 16/326,649

(22) PCT Filed: Dec. 15, 2017

(86) PCT No.: PCT/KR2017/014813
§ 371 (c)(1),
(2) Date: Feb. 19, 2019

(87) PCT Pub. No.: WO2018/236015
PCT Pub. Date: Dec. 27, 2018

(65) Prior Publication Data

US 2020/0302903 A1 Sep. 24, 2020

(30) Foreign Application Priority Data

Jun. 20, 2017 (KR) ..... 10-2017-0077908

(51) Int. Cl.
*G10H 1/36* (2006.01)
*G10H 1/00* (2006.01)
*G10H 1/46* (2006.01)

(52) U.S. Cl.
CPC ..... *G10H 1/366* (2013.01); *G10H 1/0008* (2013.01); *G10H 1/46* (2013.01);
(Continued)

(58) Field of Classification Search
CPC ..... G10H 1/366; G10H 1/0008; G10H 1/46; G10H 2210/005; G10H 2210/066;
(Continued)

(56) References Cited

U.S. PATENT DOCUMENTS 4,969,192 A * 11/1990 Chen ..... G10L 19/06 704/222
5,327,521 A * 7/1994 Savic ..... G10L 21/00 704/200
(Continued)

FOREIGN PATENT DOCUMENTS

JP 05043199 U 6/1993
JP 08194495 A 7/1996
(Continued)

OTHER PUBLICATIONS

International Search Report dated Mar. 29, 2018 for PCT Application No. PCT/KR2017/014813.

*Primary Examiner* — David S Warren
(74) *Attorney, Agent, or Firm* — EIP US LLP

(57) ABSTRACT

Disclosed are a system and a method for singing expression transplantation. A singing expression transplantation method performed by a singing expression transplantation system according to an embodiment may comprise the steps of: synchronizing each of a first sound source and a second sound source, which include different pieces of voice information with regard to an identical song; modifying the pitch of the first sound source on the basis of pitch information extracted from each of the first sound source and the second sound source, which have been synchronized; and extracting volume information from each of the first sound source and the second sound source and adjusting the magnitude of the volume regarding the first sound source, the pitch of which has been modified, according to each piece of extracted volume information.

15 Claims, 8 Drawing Sheets

(52) U.S. Cl.
CPC . *G10H 2210/005* (2013.01); *G10H 2210/066* (2013.01); *G10H 2210/076* (2013.01); *G10H 2210/331* (2013.01); *G10H 2210/375* (2013.01)

(58) Field of Classification Search
CPC ..... G10H 2210/076; G10H 2210/331; G10H 2210/375
USPC ..... 84/610
See application file for complete search history.

(56) References Cited

U.S. PATENT DOCUMENTS 5,966,687 A * 10/1999 Ojard ..... G10H 1/366 704/207
7,634,410 B2 * 12/2009 Lemoine ..... G09B 19/06 434/185
7,825,321 B2 * 11/2010 Bloom ..... G10H 1/368 84/622
7,974,838 B1 * 7/2011 Lukin ..... G10L 21/04 704/207
8,049,093 B2 * 11/2011 Jeon ..... G10H 1/0008 84/609
8,983,829 B2 * 3/2015 Cook ..... G10L 21/013 704/207
8,996,364 B2 * 3/2015 Cook ..... G10L 21/013 704/207
9,224,375 B1 * 12/2015 Hilderman ..... G10H 1/366
9,578,289 B2 * 2/2017 Roberts ..... H04N 7/17318
9,626,946 B2 * 4/2017 Hilderman ..... G10H 1/36
10,283,099 B2 * 5/2019 Hilderman ..... G10H 1/366
10,672,375 B2 * 6/2020 Salazar ..... G10H 1/368
10,685,634 B2 * 6/2020 Salazar ..... G10L 21/0356
2008/0274687 A1 * 11/2008 Roberts ..... G06Q 50/182 455/3.06
2010/0185502 A1 * 7/2010 Roberts ..... H04N 7/17318 705/14.7
2010/0304812 A1 * 12/2010 Stoddard ..... A63F 13/46 463/7
2010/0304863 A1 * 12/2010 Applewhite ..... G10H 1/0058 463/36
2012/0132056 A1 * 5/2012 Wang ..... G06F 16/683 84/609
2013/0144611 A1 * 6/2013 Ishikawa ..... G10L 19/26 704/207
2017/0140745 A1 * 5/2017 Nayak ..... H04L 65/605
2017/0160813 A1 * 6/2017 Divakaran ..... G10L 15/1815
2020/0227023 A1 * 7/2020 Conkie ..... G10L 21/003

FOREIGN PATENT DOCUMENTS

JP 2002372981 A 12/2002
KR 20090083502 A 8/2009
KR 1020140003111 A 1/2014
KR 1020150018194 A 2/2015

* cited by examiner

SINGING EXPRESSION TRANSFER SYSTEM

TECHNICAL FIELD

The following description relates to a technology for transferring a plurality of singing expressions from one voice to another with respect to the singing sources of the same song.

BACKGROUND ART

Singing is a popular musical activity that many people enjoy. Accordingly, there are various technologies for modifying audio data related to a song. For example, there is a technology for modifying the speaking of a user into a song or the singing of a user into speaking.

Furthermore, a song may be rendered into touching music or a just noisy sound depending on singing skills. The pitch modification function of a singing voice is chiefly provided through commercial vocal correction tools, such as Autotune, VariAudio and Melodyne. Some of the commercial vocal correction tools may note onset timing or other musical expressions by editing transcribed MIDI notes. As described above, the vocal correction tools provide a function capable of automatic correction, but they are inconvenient because tedious and repetitive modifications must be continuously performed until satisfactory results are obtained.

Meanwhile, as information communication is developed, an online singing room app service using smartphones has been activated. The singing room app service stores multiple sounds for accompaniment, plays back a corresponding sound in response to a user's input, and displays a moving image, such as lyrics and music video, on a screen along with the corresponding sound so that a user views the moving image.

Korean Patent Application Publication No. 10-2009-0083502 relates to a technology for helping a singing person to have an expert' speaking and technology. The technology provides a function for enabling a user to selectively change vibration, a high-pitched tone, tuning, pitch, etc. with respect to a portion having insufficient expressions using a simple button and a controller when the user sings a song using a microphone in a singing room. However, the conventional technology has only to change information on sheet music, such as a scale or onset, but cannot transfer music expressions, such as another user's tempo, pitch or dynamics, into a user's singing voice using another user's singing voice.

DISCLOSURE

Technical Problem

There can be provided a method and system for transferring musical expressions, such as a tempo, a pitch and dynamics, from one voice to another voice with respect to a plurality of singing voices including different voice information of the same song.

Technical Solution

A singing expression transfer method performed in a singing expression transfer system may include the steps of synchronizing the syncs of a source singing voice and a target singing voice including different voice information with respect to the same song, modifying a pitch of the source singing voice based on pitch information extracted from each of the synchronized source singing and target singing voices, and extracting dynamics information from each of the source singing voice and the target singing voice and adjusting the amplitude of dynamics for the source singing voice having the pitch modified based on the pieces of dynamics information.

The step of synchronizing the syncs of the source singing voice and target singing voice including the different voice information with respect to the same song may include the step of extracting features related to a common element included in the first and second singing voices.

The step of synchronizing the syncs of the source singing voice and target singing voice including the different voice information with respect to the same song may include the steps of obtaining the least path by computing a similarity matrix for the features extracted from the source singing voice and the target singing voice and computing a time curve based on the obtained path.

The step of synchronizing the syncs of the source singing voice and target singing voice including the different voice information with respect to the same song may include the step of modifying the audio length of the source singing voice by applying a ratio that the length of audio is adjusted for each time unit in the computed time curve.

The step of modifying the pitch of the source singing voice based on the pitch information extracted from each of the synchronized source singing and target singing voices may include the step of obtaining singing voices including respective harmonic tones by separating the harmonic tone and a percussive tone from each of the synchronized source singing and target singing voices.

The step of modifying the pitch of the source singing voice based on the pitch information extracted from each of the synchronized source singing and target singing voices may include the step of extracting pitches and pitch mark values simultaneously from the singing voices including the respective harmonic tones.

The step of modifying the pitch of the source singing voice based on the pitch information extracted from each of the synchronized source singing and target singing voices may include the step of shifting the pitch of the source singing voice based on the extracted pitch mark values and a pitch ratio obtained by comparing the extracted pitch information of the target singing voice with the extracted pitch information of the source singing voice.

In a computer program stored in a storage medium in order to execute a singing expression transfer method, the singing expression transfer method may include the steps of synchronizing the syncs of a source singing voice and a target singing voice including different voice information with respect to the same song, modifying a pitch of the source singing voice based on pitch information extracted from each of the synchronized source singing and target singing voices, and extracting dynamics information from each of the source singing voice and the target singing voice and adjusting the amplitude of dynamics for the source singing voice having the pitch modified based on the pieces of dynamics information.

A singing expression transfer system may include a temporal alignment unit synchronizing the syncs of a source singing voice and a target singing voice including different voice information with respect to the same song, a modification pitch alignment unit modifying a pitch of the source singing voice based on pitch information extracted from each of the synchronized source singing and target singing voices, and a dynamics alignment unit extracting dynamics information from each of the source singing voice and the target singing voice and adjusting the amplitude of dynamics for the source singing voice having the pitch modified based on the pieces of dynamics information.

The temporal alignment unit may extract features related to a common element included in the first and second singing voices.

The temporal alignment unit may obtain the least path by computing a similarity matrix for the features extracted from the source singing voice and the target singing voice, and may compute a time curve based on the obtained path.

The temporal alignment unit may modify the audio length of the source singing voice by applying a ratio that the length of audio is adjusted for each time unit in the computed time curve.

The pitch alignment unit may obtain singing voices including respective harmonic tones by separating the harmonic tone and a percussive tone from each of the synchronized source singing and target singing voices.

The pitch alignment unit may extract pitches and pitch mark values simultaneously from the singing voices including the respective harmonic tones.

The pitch alignment unit may shift the pitch of the source singing voice based on the extracted pitch mark values and a pitch ratio obtained by comparing the extracted pitch information of the target singing voice with the extracted pitch information of the source singing voice.

Advantageous Effects

The singing expression transfer system according to an embodiment can transfer sophisticated expressions of a target singing voice into a source singing voice without a change in the tone of the source singing voice.

The singing expression transfer system according to an embodiment can be effectively used for the automatic correction of a singing voice because it can correct a singing voice that has not been sung well using a singing voice that has been sung well.

The singing expression transfer system according to an embodiment can minimize problems, such as noise, detour and distortion, and can solve a problem, such as a long time taken to align a tempo, a pitch and dynamics, by automatically processing tempo, pitch and dynamics analysis for a plurality of singing voices and all audio signal processing operations.

BEST MODE

Hereinafter, embodiments are described in detail with reference to the accompanying drawings.

In the following embodiments, a method and system for transferring singing expressions through a singing to singing comparison are described. In general, singing voices including a plurality of pieces of different voice information may be input with respect to the same song. For example, an ordinary person or a singer (expert) may sing with respect to the same song. Although a sing is the same song, singing voices of various versions may be present. In this case, in a song sung by an ordinary person, information related to a tempo, a pitch and dynamics may be different from music information set in the original song. Accordingly, a method and system for improving quality of a singing voice sung by an ordinary person by comparing the singing voice sung by the ordinary person with a singing voice sung by a singer and transferring sophisticated information related to the singing voice of the singer into the singing voice sung by the ordinary person are described in detail.

Figure 1:
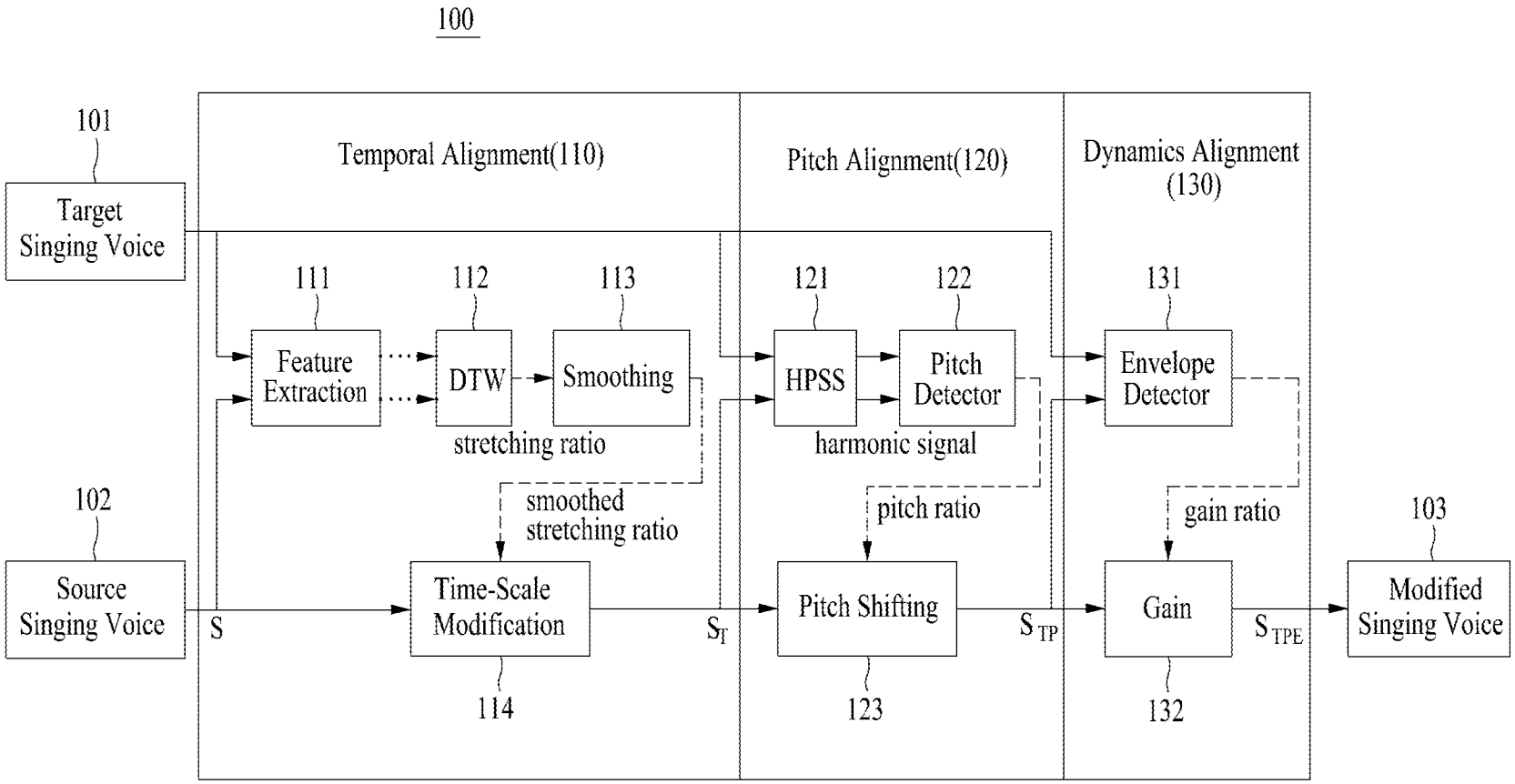
FIG. 1 is a diagram for illustrating an operation of a singing expression transfer system according to an embodiment.

FIG. 1 is a diagram for illustrating an operation of a singing expression transfer system according to an embodiment.

A plurality of singing voices including different voice information may be present with respect to the same song. In other words, the same song may be sung by different users. In this case, a singing voice may include lyrics information and accompaniment sung by each user. Hereinafter, a singing voice sung by one user is called a source singing voice 102, and a singing voice sung by the other user is called a target singing voice 101.

In order to describe an operation of transferring singing expressions of the target singing voice 101 into the source singing voice 102, for example, it is assumed that a song sung by an ordinary person is the source singing voice 102 and a song sung by a singer is the target singing voice 101. Meanwhile, in FIG. 1, a singing voice is limited to the source singing voice and the target singing voice including two pieces of different voice information, but is not essentially limited to the singing voices including the two pieces of voice information.

The singing expression transfer system 100 may receive the source singing voice 102 and the target singing voice 101. Alternatively, for example, the singing expression transfer system 100 may extract the target singing voice 101 similar to the source singing voice 102, stored in a database, when the source singing voice 102 is input.

The singing expression transfer system 100 may perform a process of temporal alignment (110), a process of pitch alignment (120), and a process of dynamics alignment (130).

The singing expression transfer system 100 may synchronize the syncs of the source singing voice 102 and the target singing voice 101 as the tempos (rhythms) of the source singing voice 102 are aligned (110). The singing expression transfer system 100 may extract features (feature extraction) (111) related to a common element (e.g., melody, lyrics), included in the source singing voice 102 and the target singing voice 101, in order to temporally align the source singing voice 102 and the target singing voice 101. The singing expression transfer system 100 may extract the features of audio data from the signals of the source singing voice 102 and the target singing voice 101. For example, the singing expression transfer system 100 may apply max filtering to the spectra of the source singing voice 102 and the target singing voice 101, may use voice information shared in the lyrics of music, and may extract a voice formant feature or a phoneme classifier feature including lyrics information.

The singing expression transfer system 100 may perform dynamic time warping (DTW) (112) based on the features extracted from the source singing voice 102 and the target singing voice 101. The singing expression transfer system 100 may temporally align the time-series data of the source singing voice 102 and the target singing voice 101. The singing expression transfer system 100 may compute a similarity matrix based on the features extracted from the source singing voice 102 and the target singing voice 101.

Figure 5:
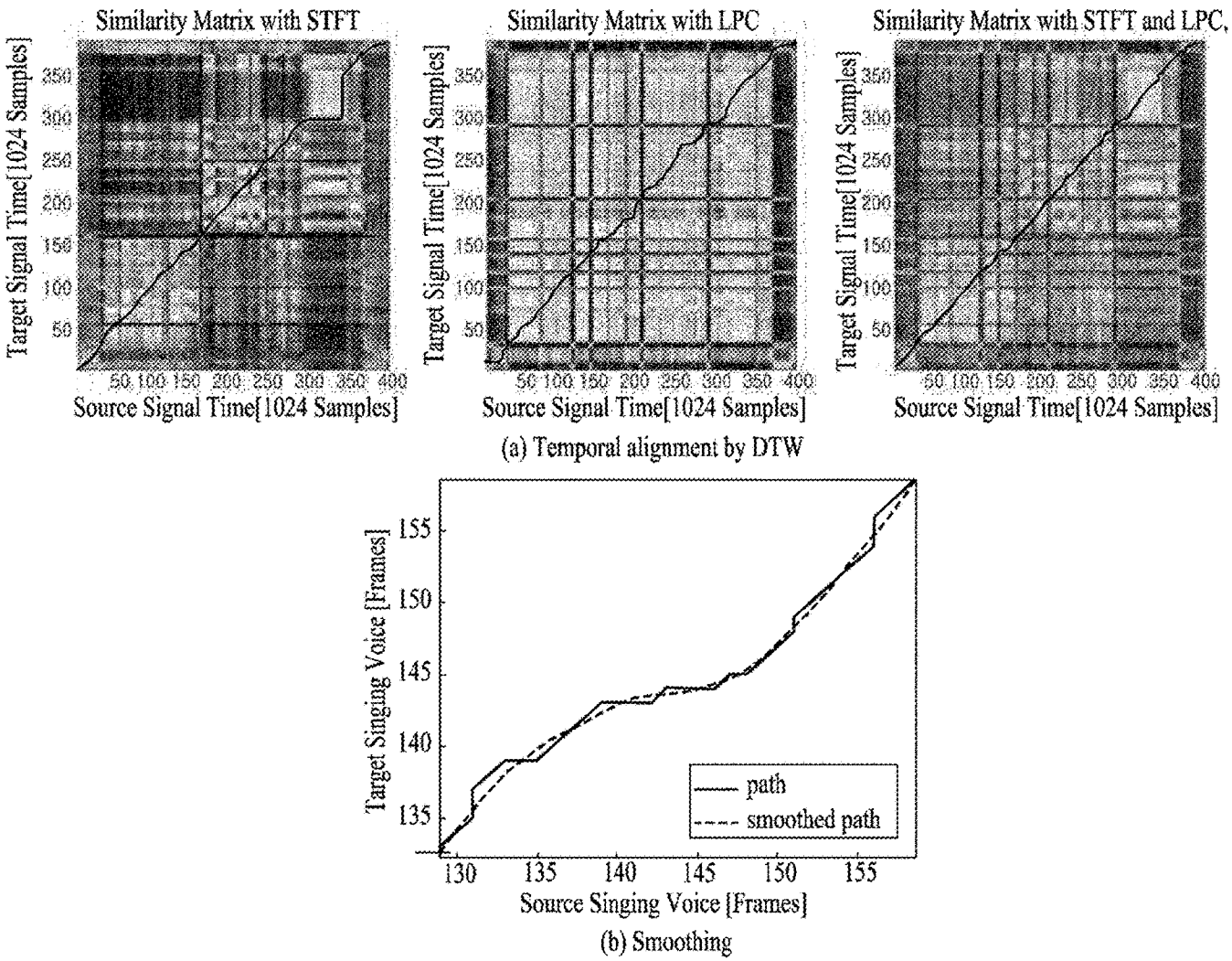
FIG. 5 is a diagram showing a dynamic time warping (DTW) process performed in the singing expression transfer system according to an embodiment.

FIG. 5 is a diagram showing a dynamic time warping (DTW) (112) process performed in the singing expression transfer system. FIG. 5(*a*) shows that tempos are aligned by DTW. FIG. 5(*a*) shows the results of the path of DTW having a similarity matrix. Each element may be computed from a cosine distance between all pairs of two magnitude spectra. In this case, the slope of a line may mean the ratio of tempos for each time. For example, when strong vibrato is included in voice information of a singing voice, a severe detour may occur in a 300-350 time range. In order to solve a detour or/and distortion problem that may occur due to voice information included in a singing voice, the singing expression transfer system 100 may search for a more precise path by extracting features using an STFT method, a combined method of STFT and linear prediction coefficients (LPC) or a method of applying a maximum filter to modified STFT using a Mel-Scale or modified STFT using Mel-Scale and then combining LPC, for example, and then computing a similarity matrix. In the STFT, a path is determined based on information of a spectrum itself. In the LPC, a path is determined based on pronunciation information included in a singing voice. In this case, the ratios of the STFT and LPC may be differently adjusted depending on the singing voice. Alternatively, the singing expression transfer system 100 may perform mapping based on constant-Q transform in melody information included in a singing voice so that a frequency index in the time-frequency representation corresponds to a semitone in the singing voice (i.e., to have the same scale as that of piano), and may extract phoneme information, obtained on frame-by-frame basis, from lyrics information included in the singing voice using a phoneme classifier.

The singing expression transfer system 100 may compute a similarity matrix with respect to the features extracted from the source singing voice 102 and the target singing voice 102, and may compute the least path using dynamic programming. In other words, the singing expression transfer system 100 performs the DTW process and determines that which path will be taken. As the singing expression transfer system 100 performs the DTW process, the computed least path may be adjusted. In this case, since the aligned least path moves in three directions (e.g., upward direction, right direction and diagonal direction) every frame, the singing expression transfer system 100 may process smoothing (113) so that a stretching ratio is included in a preset angle range and thus the least path is naturally performed. For example, the singing expression transfer system 100 may compute a smoother time curve for the computed least path using Savitzky-Golay Filtering or Constrained Least Squares. FIG. 5(*b*) shows the results of the execution of smoothing through Savitzky-Golay Filtering. The singing expression transfer system 100 can improve a problem in that a specific frame is lengthened or shortened by increasing or decreasing the speed with respect to the specific frame.

The singing expression transfer system 100 may perform a time-scale modification (114) process. The singing expression transfer system 100 may modify the length of audio of the source singing voice 102 based on the ratio that the length of audio is adjusted for each time unit as the smooth time curve is computed. The singing expression transfer system 100 may adjust the length of audio of the source singing voice 102 by overlapping and comparing the target singing voice 101 with the source singing voice 102. For example, the singing expression transfer system 100 may adjust the length of audio of the source singing voice 102 using a Phase Vocoder algorithm in which the distortion of a tone less occurs in a single-sound singing voice sample, Waveform Similarity based Overlap-Add (WSOLA), etc.

The singing expression transfer system according to an embodiment may synchronize syncs through a pure audio to audio comparison without distinguishing between the nodes of lyrics information included in a singing voice.

The singing expression transfer system 100 may modify the pitch of the source singing voice 102 (120) based on pitch information extracted from the source singing voice 102 and target singing voice 101 having their syncs synchronized. The singing expression transfer system 100 may perform harmonic-percussive source separation (HPSS) (121). The singing expression transfer system 100 may separate the harmonic element and percussive element of the singing voice in order to measure the pitch of the singing voice more precisely. The singing expression transfer system 100 may obtain singing voices including respective harmonic tones by separating a harmonic tone and a percussive tone from each of the source singing voice 102 and target singing voice 101 having their syncs synchronized. In this case, for example, the pitch alignment unit 220 may process the separation of the harmonic tone and the percussive tone using a median filter, etc.

The process of aligning pitches may be basically divided into a method of combining a time-domain modification algorithm using WSOLA or a time-frequency domain modification algorithm using a Phase Vocoder and resampling and a method of extracting pitch marks and applying a pitch-synchronous overlap and add (PSOLA) algorithm. The singing expression transfer system 100 may perform the process of aligning pitches through the method of combining a time-domain modification algorithm using WSOLA or a time-frequency domain modification algorithm using a Phase Vocoder and resampling and the method of extracting pitch marks and applying the PSOLA algorithm.

In one embodiment, a method of aligning pitches using the pitch-synchronous overlap and add (PSOLA) algorithm having less distortion of a voice formant is described. The singing expression transfer system 100 may extract a pitch mark value in order to drive the PSOLA algorithm that maintains a tone because a voice formant is preserved although a pitch varies in a sample related to the singing voice of a single tone, and may align pitches using the extracted pitch mark values. The singing expression transfer system 100 may detect pitches (pitch detector) (122) from the singing voices including respective harmonic tones. The singing expression transfer system 100 may extract a pitch and a pitch mark value from a singing voice, including each harmonic tone, at the same time. In this case, the pitch mark value may mean that information is included at the location where the information is extracted from a pitch including a harmonic tone. The singing expression transfer system 100 may extract the pitch using various methods, but may extract the pitch using an average magnitude difference function (AMDF) in the case of a singing voice of a single sound, for example.

Meanwhile, the singing expression transfer system 100 may track pitches through a YIN algorithm. The singing expression transfer system 100 may determine whether the pitch of the source singing voice needs to be changed based on the extracted pitch information because the syncs of the source singing voice 102 and the target singing voice 101 have been synchronized.

Figure 7:
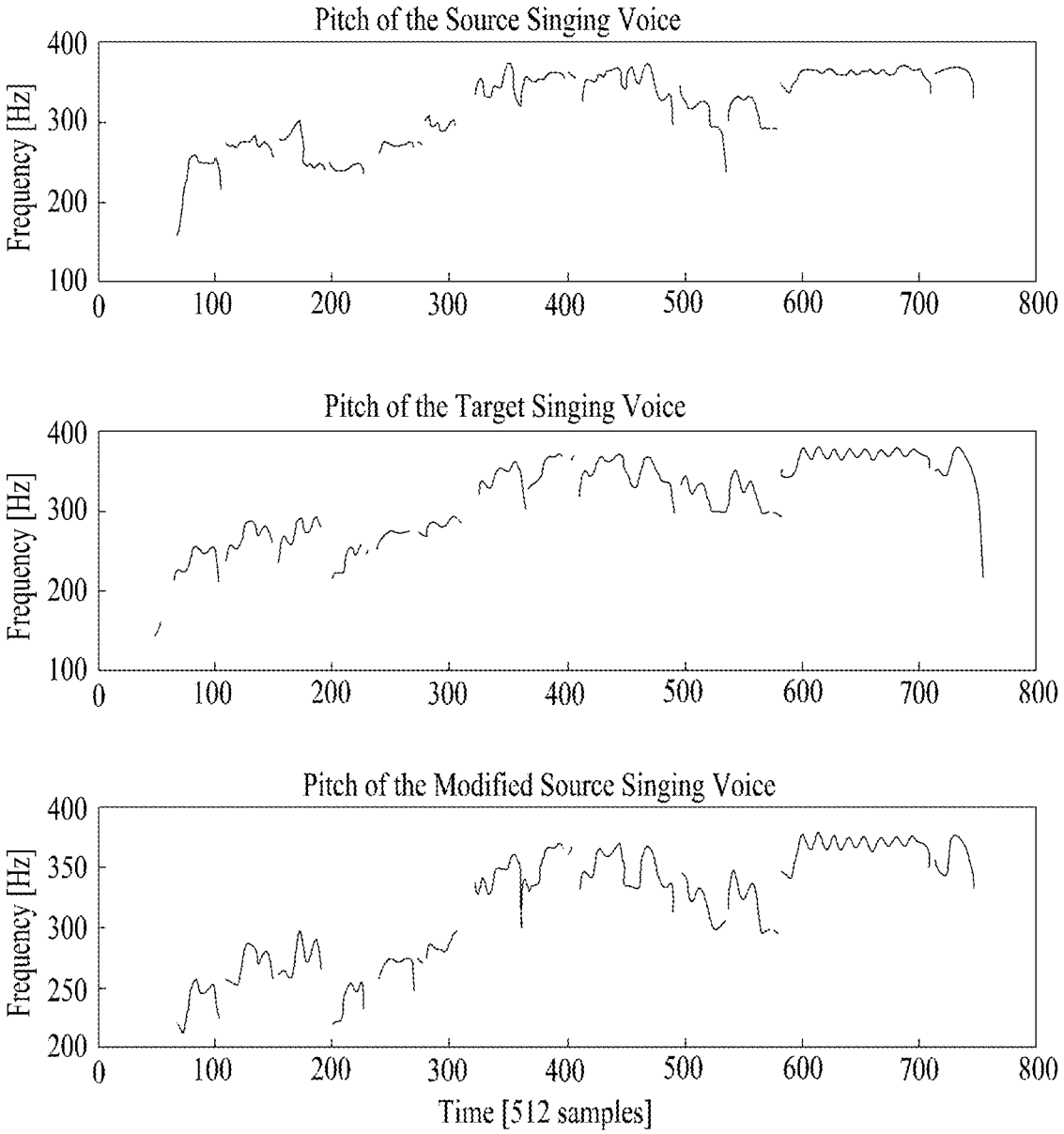
FIG. 7 is a diagram showing an example in which pitches have been aligned in the singing expression transfer system according to an embodiment.

The singing expression transfer system 100 may modify the pitch of the source singing voice 102 based on the extracted pitch mark values and a pitch ratio obtained by comparing the extracted pitch information of the second singing voice 101 with the extracted pitch information of the first singing voice 102. Accordingly, the singing expression transfer system 100 shifts the pitch of the source singing voice 102 (pitch shifting) (123) similar or identical with the pitch of the target singing voice 101. FIG. 7 is a graph showing that the pitch of the source singing voice 102 has been adjusted through the process.

Figure 8:
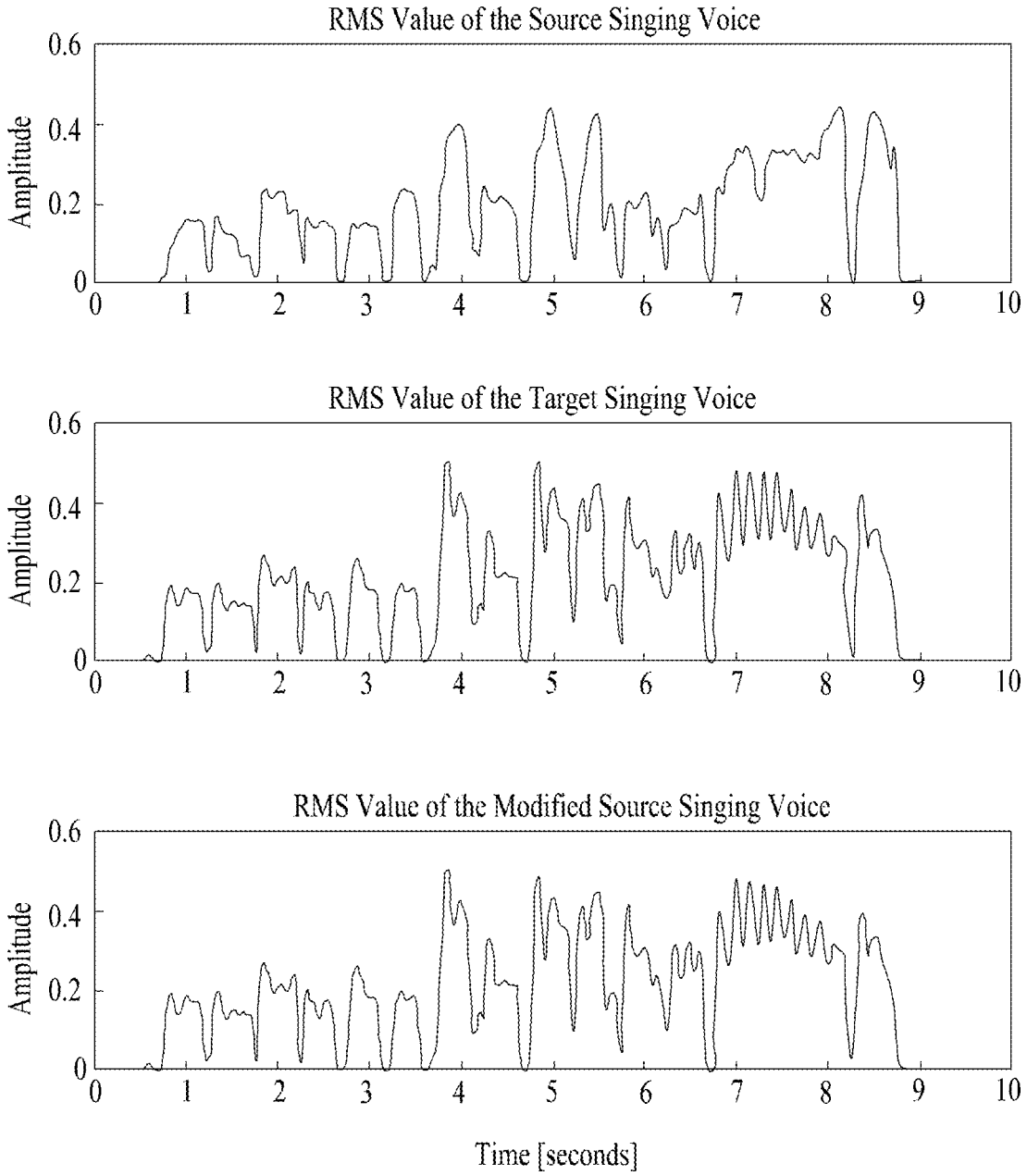
FIG. 8 is a diagram showing an example in which dynamics have been aligned in the singing expression transfer system according to an embodiment.

The singing expression transfer system 100 may align the dynamics of the source singing voice 102 (130). The singing expression transfer system 100 may extract dynamics information (envelope detector) (131) of each of the source singing voice 102 and the target singing voice 101, and may adjust the amplitude of the dynamics (gain) (132) for the source singing voice having a pitch modified based on each piece of dynamics information. More specifically, the singing expression transfer system 10 may extract an energy value for each time zone of the source singing voice and the target singing voice using a root mean square (RMS), for example, and may adjust the amplitude of the source singing voice for each time zone using the ratio of energy values for each time zone. FIG. 8 is a graph showing that the energy values of the source singing voice have been adjusted through energy values for each time zone of the source singing voice and energy values for each time zone of the target singing voice. Accordingly, the singing expression transfer system 100 can obtain the source singing voice having a tempo, pitch and dynamics modified.

Figure 2:
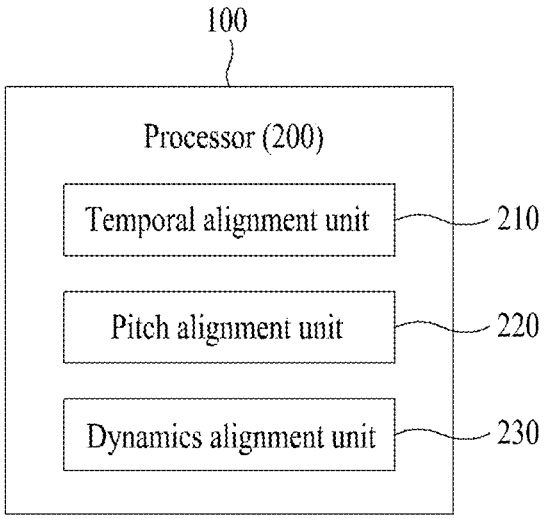
FIG. 2 is a block diagram for illustrating a configuration of the singing expression transfer system according to an embodiment.
Figure 3:
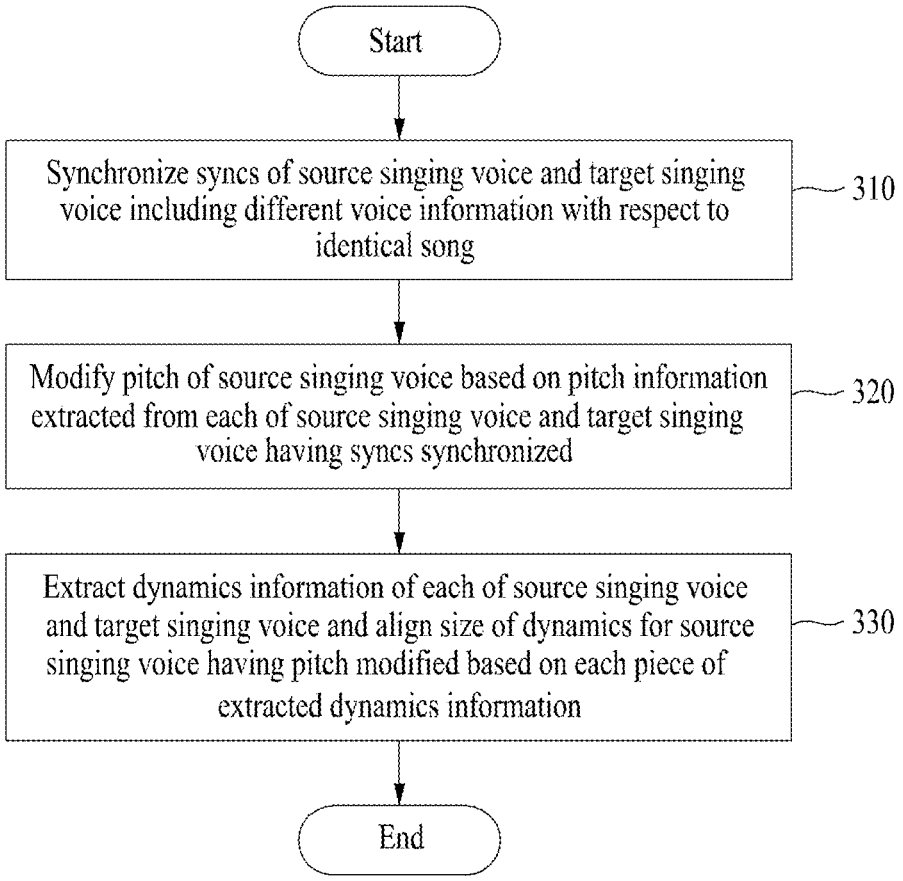
FIG. 3 is a flowchart for illustrating a singing expression transfer method in the singing expression transfer system according to an embodiment.

FIG. 2 is a block diagram for illustrating a configuration of the singing expression transfer system according to an embodiment. FIG. 3 is a flowchart for illustrating a singing expression transfer method in the singing expression transfer system according to an embodiment.

The processor 200 of the singing expression transfer system 100 may include a temporal alignment unit 210, a pitch alignment unit 220 and a dynamics alignment unit 230. The processor 200 and the elements of the processor 200 may control the singing expression transfer system so that it performs steps 310 to 330 included in the singing expression transfer method of FIG. 3. In this case, the processor 200 and the elements of processor 200 may be implemented to execute instructions according to code of an operating system and code of at least one program included in memory. In this case, the elements of the processor 200 may be expressions of different functions performed by the processor 200 in response to a control command provided by program code stored in the singing expression transfer system 100.

The processor 200 may load program code, stored in a file of a program for the singing expression transfer method, onto the memory. For example, when the program is executed in the singing expression transfer system 100, the processor may control the singing expression transfer system so that it loads the program code from the file of the program to the memory under the control of the operating system.

Figure 4:
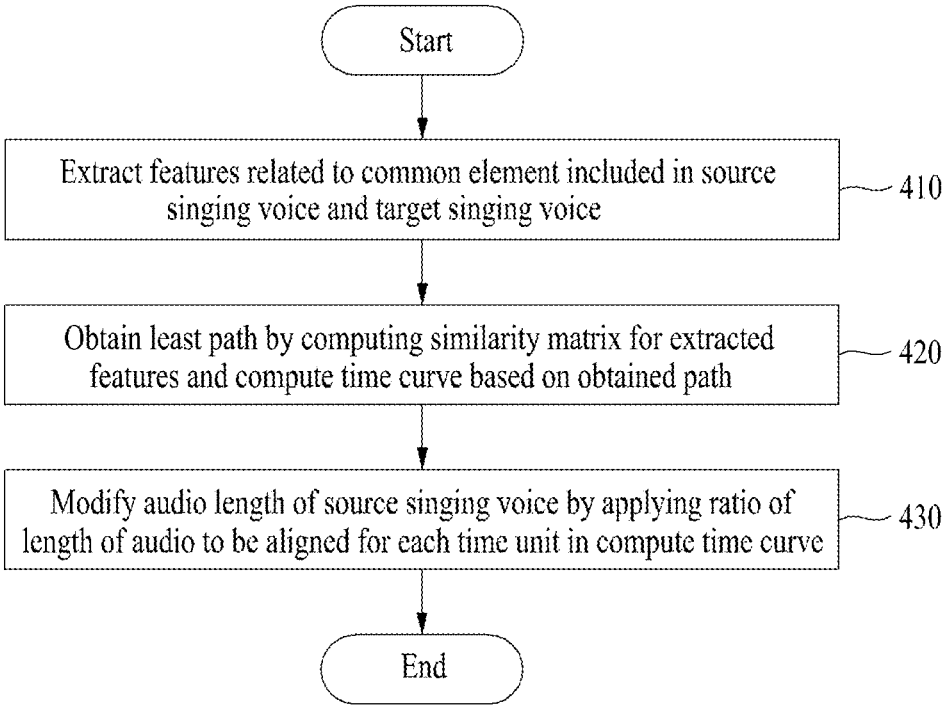
FIG. 4 is a flowchart for illustrating a method of aligning tempos in the singing expression transfer system according to an embodiment.

At step 310, the temporal alignment unit 210 may synchronize the syncs of a source singing voice and target singing voice including different voice information with respect to the same song. More specifically, FIG. 4 is a flowchart for illustrating a method of aligning tempos. At step 410, the temporal alignment unit 210 may extract features related to a common element included in the source singing voice and the target singing voice. More specifically, the temporal alignment unit 210 may extract features related to an element (e.g., melody, lyrics) common in two songs in order to temporally align the source singing voice and the target singing voice. For example, the temporal alignment unit 210 may extract features related to a pitch from each of the source singing voice and the target singing voice, and may reduce the difference between the pitches of the source singing voice and the target singing voice using quantization, a maximum value filter, etc. Furthermore, the temporal alignment unit 210 may extract voice formant features, including lyrics information, or portions including the same lyrics information through a phoneme classifier, from each of the source singing voice and the target singing voice. For another example, the temporal alignment unit 210 may extract lyrics information, included in each of the source singing voice and the target singing voice, on frame-by-frame basis using the phoneme classifier, and may use melody information, included in each of the source singing voice and the target singing voice, so that a frequency index in time-frequency representation has been mapped to correspond to a semitone in music (i.e., have the same scale as that of piano) using constant-Q transform.

At step 420, the temporal alignment unit 210 may obtain the least path by computing a similarity matrix for the extracted features, and may compute a time curve based on the obtained path. In general, since a singing voice is played back over time, the temporal alignment unit 210 may temporally align the time-series data of the source singing voice and the time-series data of the target singing voice. More specifically, the temporal alignment unit 210 may obtain the least path by computing the similarity matrix for the features extracted from the source singing voice and the target singing voice. For example, the temporal alignment unit 210 may extract the features from a max-filtered spectrum and LPCs, and may align tempos by computing the similarity matrix. The temporal alignment unit 210 may compute the similarity matrix for the features extracted from the source singing voice and the target singing voice and then compute the least path using dynamic programming.

At step 430, the temporal alignment unit 210 may modify the audio length of the source singing voice by applying the ratio that the length of audio is adjusted for each time unit in the computed time curve. For example, the temporal alignment unit 210 may compute the time curve of the computed least path using Savitzky-Golay filtering or constrained least squares. The temporal alignment unit 210 may adjust the computed time curve based on a preset slope (e.g., based on 45 degrees).

Figure 6:
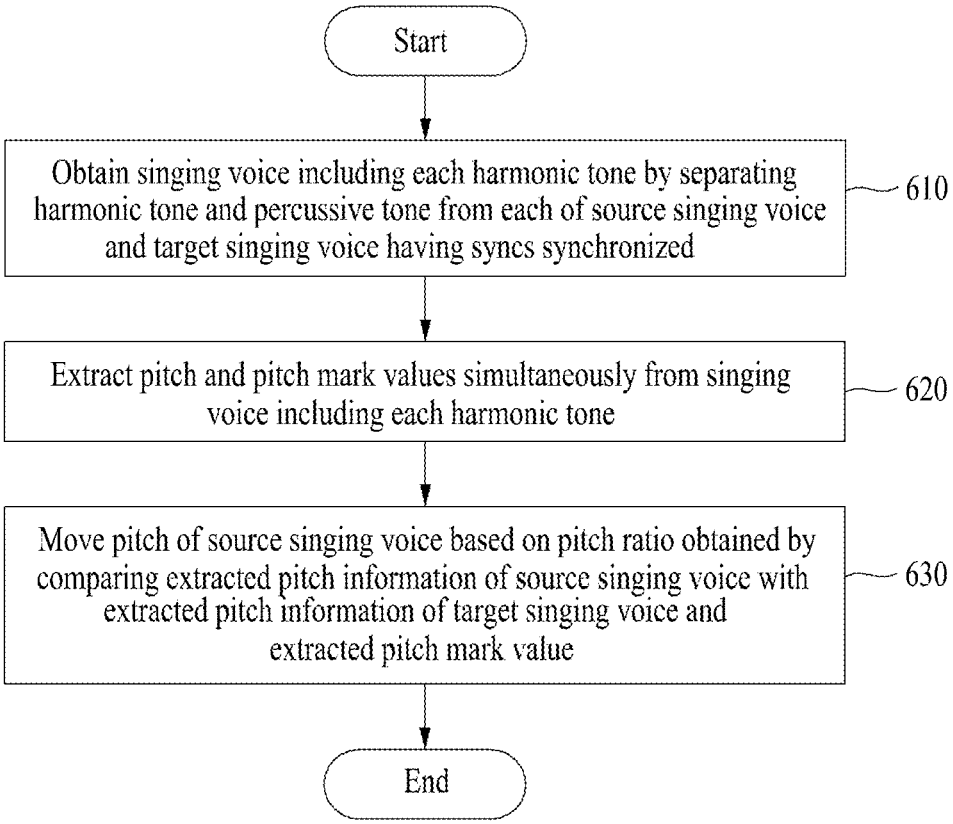
FIG. 6 is a diagram for illustrating a method of aligning pitches in the singing expression transfer system according to an embodiment.

At step 320, the pitch alignment unit 220 may modify the pitch of the source singing voice based on pitch information extracted from each of the source singing voice and the target singing voice having syncs synchronized. FIG. 6 is a flowchart for illustrating a method of aligning pitches. In one embodiment, a method of aligning pitches using the pitch-synchronous overlap and add (PSOLA) algorithm having less distortion of a voice formant is described. The pitch alignment unit 220 may separate the harmonic element and percussive element of the singing voice in order to measure the pitch of the singing voice more precisely. At step 610, the pitch alignment unit 220 may obtain singing voices including respective harmonic tones by separating a harmonic tone and percussive tone from each of the source singing voice and the target singing voice having syncs synchronized. For example, the pitch alignment unit 220 may process the separation of the harmonic tone and percussive tone using a median filter. Accordingly, the pitch alignment unit 220 obtains the source singing voice including a harmonic tone and the target singing voice including a harmonic tone.

At step 620, the pitch alignment unit 220 may extract pitches and pitch mark values at the same time from the singing voices including the respective harmonic tones. For example, the pitch alignment unit 220 may extract the pitch using an amplitude difference function. In this case, the pitch alignment unit 220 may extract the pitches from the singing voices including the harmonic tones, and may simultaneously extract the pitch mark values for aligning the pitches.

At step 630, the pitch alignment unit 220 may shift the pitch of the source singing voice based on the extracted pitch mark values and a pitch ratio obtained by comparing the extracted pitch information of the target singing voice with the extracted pitch information of the source singing voice. For example, the pitch alignment unit 220 may use the pitch-synchronous overlap and add (PSOLA) algorithm that maintains a tone because the voice formant is preserved although a pitch is changed in a sample related to the singing voice of a single tone. The pitch alignment unit 220 may use the pitch ratio, obtained by comparing the extracted pitch information of the target singing voice with the extracted pitch information of the source singing voice, and the pitch mark values obtained in the pitch extraction process performed by the PSOLA algorithm as input values. Accordingly, the pitch alignment unit 220 shifts the pitch of the source singing voice.

At step 330, the dynamics alignment unit 230 may extract dynamics information of each of the source singing voice and the target singing voice, and may align the amplitude of dynamics of the source singing voice having a pitch modified based on the extracted dynamics information. The dynamics alignment unit 230 may extract energy values for each time zone of the source singing voice and the target singing voice using root mean square (RMS), for example, and may adjust the amplitude of the source singing voice for each time zone using the ratio of the energy values for each time zone.

The aforementioned apparatus may be implemented in the form of a combination of hardware elements, software elements and/or hardware elements and software elements. For example, the apparatus and elements described in the embodiments may be implemented using one or more general-purpose computers or special-purpose computers, for example, a processor, a controller, an arithmetic logic unit (ALU), a digital signal processor, a microcomputer, a field programmable array (FPA), a programmable logic unit (PLU), a microprocessor or any other device capable of executing or responding to an instruction. The processing device may perform an operating system (OS) and one or more software applications executed on the OS. Furthermore, the processing device may access, store, manipulate, process and generate data in response to the execution of software. For convenience of understanding, one processing device has been illustrated as being used, but a person having ordinary skill in the art may be aware that the processing device may include a plurality of processing elements and/or a plurality of types of processing elements. For example, the processing device may include a plurality of processors or a single processor and a single controller. Furthermore, other processing configurations, such as a parallel processor, are also possible.

Software may include a computer program, code, an instruction or one or more combinations of them and may configure the processing device so that it operates as desired or may instruct the processing device independently or collectively. The software and/or data may be interpreted by the processing device or may be embodied in a machine, component, physical device, virtual equipment or computer storage medium or device of any type or a transmitted signal wave permanently or temporarily in order to provide an instruction or data to the processing device. The software may be distributed to computer systems connected over a network and may be stored or executed in a distributed manner. The software and data may be stored in one or more computer-readable recording media.

The method according to the embodiment may be implemented in the form of a program instruction executable by various computer means and stored in a computer-readable recording medium. The computer-readable recording medium may include a program instruction, a data file, and a data structure solely or in combination. The program instruction recorded on the recording medium may have been specially designed and configured for the embodiment or may be known to those skilled in computer software. The computer-readable recording medium includes a hardware device specially configured to store and execute the program instruction, for example, magnetic media such as a hard disk, a floppy disk, and a magnetic tape, optical media such as CD-ROM or a DVD, magneto-optical media such as a floptical disk, ROM, RAM, or flash memory. Examples of the program instruction may include both machine-language code, such as code written by a compiler, and high-level language code executable by a computer using an interpreter.

Mode for Invention

As described above, although the embodiments have been described in connection with the limited embodiments and the drawings, those skilled in the art may modify and change the embodiments in various ways from the description. For example, proper results may be achieved although the aforementioned descriptions are performed in order different from that of the described method and/or the aforementioned elements, such as the system, configuration, device, and circuit, are coupled or combined in a form different from that of the described method or replaced or substituted with other elements or equivalents.

Accordingly, other implementations, other embodiments, and the equivalents of the claims belong to the scope of the claims.

The invention claimed is:

1. A singing expression transfer method performed in a singing expression transfer system, the method comprising steps of:

synchronizing syncs of a source singing voice and a target singing voice comprising different voice information with respect to an identical song;

modifying a pitch of the source singing voice based on pitch information extracted from each of the synchronized source singing and target singing voices; and extracting dynamics information from each of the source singing voice and the target singing voice and adjusting an amplitude of dynamics for the source singing voice having the pitch modified based on the pieces of dynamics information.

2. The singing expression transfer method of claim 1, wherein the step of synchronizing the syncs of the source singing voice and target singing voice comprising the different voice information with respect to the identical song comprises a step of extracting features related to a common element included in the first and second singing voices.

3. The singing expression transfer method of claim 2, wherein the step of synchronizing the syncs of the source singing voice and target singing voice comprising the different voice information with respect to the identical song comprises steps of:

obtaining a least path by computing a similarity matrix for the features extracted from the source singing voice and the target singing voice, and computing a time curve based on the obtained path.

4. The singing expression transfer method of claim 3, wherein the step of synchronizing the syncs of the source singing voice and target singing voice comprising the different voice information with respect to the identical song comprises a step of modifying an audio length of the source singing voice by applying a ratio that the length of audio is adjusted for each time unit in the computed time curve.

5. The singing expression transfer method of claim 1, wherein the step of modifying the pitch of the source singing voice based on the pitch information extracted from each of the synchronized source singing and target singing voices comprises a step of obtaining singing voices including respective harmonic tones by separating the harmonic tone and a percussive tone from each of the synchronized source singing and target singing voices.

6. The singing expression transfer method of claim 5, wherein the step of modifying the pitch of the source singing voice based on the pitch information extracted from each of the synchronized source singing and target singing voices comprises a step of extracting pitches and pitch mark values simultaneously from the singing voices comprising the respective harmonic tones.

7. The singing expression transfer method of claim 6, wherein the step of modifying the pitch of the source singing voice based on the pitch information extracted from each of the synchronized source singing and target singing voices comprises a step of shifting the pitch of the source singing voice based on the extracted pitch mark values and a pitch ratio obtained by comparing the extracted pitch information of the target singing voice with the extracted pitch information of the source singing voice.

8. A computer program stored in a storage medium in order to execute a singing expression transfer method, wherein the singing expression transfer method comprises steps of:

synchronizing syncs of a source singing voice and a target singing voice comprising different voice information with respect to an identical song;

modifying a pitch of the source singing voice based on pitch information extracted from each of the synchronized source singing and target singing voices; and extracting dynamics information from each of the source singing voice and the target singing voice and adjusting an amplitude of dynamics for the source singing voice having the pitch modified based on the pieces of dynamics information.

9. A singing expression transfer system, comprising:

a temporal alignment unit synchronizing syncs of a source singing voice and a target singing voice comprising different voice information with respect to an identical song;

a modification pitch alignment unit modifying a pitch of the source singing voice based on pitch information extracted from each of the synchronized source singing and target singing voices; and a dynamics alignment unit extracting dynamics information from each of the source singing voice and the target singing voice and adjusting an amplitude of dynamics for the source singing voice having the pitch modified based on the pieces of dynamics information.

10. The singing expression transfer system of claim 9, wherein the temporal alignment unit extracts features related to a common element included in the first and second singing voices.

11. The singing expression transfer system of claim 10, wherein the temporal alignment unit obtains a least path by computing a similarity matrix for the features extracted from the source singing voice and the target singing voice and computes a time curve based on the obtained path.

12. The singing expression transfer system of claim 11, wherein the temporal alignment unit modifies an audio length of the source singing voice by applying a ratio that the length of audio is adjusted for each time unit in the computed time curve.

13. The singing expression transfer system of claim 9, wherein the pitch alignment unit obtains singing voices including respective harmonic tones by separating the harmonic tone and a percussive tone from each of the synchronized source singing and target singing voices.

14. The singing expression transfer system of claim 13, wherein the pitch alignment unit extracts pitches and pitch mark values simultaneously from the singing voices comprising the respective harmonic tones.

15. The singing expression transfer system of claim 14, wherein the pitch alignment unit shifts the pitch of the source singing voice based on the extracted pitch mark values and a pitch ratio obtained by comparing the extracted pitch information of the target singing voice with the extracted pitch information of the source singing voice.

* * * * *